US010520178B2

(12) United States Patent
Desai et al.

(10) Patent No.: US 10,520,178 B2
(45) Date of Patent: Dec. 31, 2019

(54) ANGULAR CONNECTION SYSTEM FOR A LUMINAIRE

(71) Applicant: Focal Point, LLC, Chicago, IL (US)

(72) Inventors: Krutin S. Desai, Chicago, IL (US); Michael David SanFacon, Naperville, IL (US)

(73) Assignee: Focal Point, LLC, Chicago, IL (US)

( * ) Notice: Subject to any disclaimer, the term of this patent is extended or adjusted under 35 U.S.C. 154(b) by 389 days.

(21) Appl. No.: 15/287,341

(22) Filed: Oct. 6, 2016

(65) Prior Publication Data

US 2017/0211784 A1 Jul. 27, 2017

Related U.S. Application Data

(60) Provisional application No. 62/237,935, filed on Oct. 6, 2015.

(51) Int. Cl.

| | |
|---|---|
| ***F21V 23/00*** | (2015.01) |
| ***F21V 23/06*** | (2006.01) |
| *F21Y 115/10* | (2016.01) |
| *F21S 2/00* | (2016.01) |
| *F21V 21/005* | (2006.01) |

(52) U.S. Cl.

CPC ..... *F21V 23/003* (2013.01); *F21V 23/001* (2013.01); *F21V 23/06* (2013.01); *F21S 2/00* (2013.01); *F21V 21/005* (2013.01); *F21Y 2115/10* (2016.08)

(58) Field of Classification Search

CPC ..... F21S 4/20; F21S 8/037; F21S 8/06; F21S 8/04; F21S 4/28; F21Y 2115/10; F21V 21/005; F21V 23/06; F21V 15/01

USPC ..... 362/632–634, 217.11–217.17, 368–371, 362/391

See application file for complete search history.

(56) References Cited

U.S. PATENT DOCUMENTS 7,794,132 B2 * 9/2010 Cunius ..... F21S 4/20 362/391

8,251,543 B2 * 8/2012 Bauer ..... F21S 8/037 362/217.14

* cited by examiner

*Primary Examiner* — William J Carter

(74) *Attorney, Agent, or Firm* — Banner & Witcoff, Ltd.

(57) ABSTRACT

A connection system for a luminaire that includes a cover having a base wall, a first side wall, a second side wall, and a plurality of guides; and a connector having a top surface, a bottom surface, a first side wall, a second side wall, a plurality of guides, where the plurality of guides of the cover engage the plurality of guides of the connector. The cover may be slidably engaged onto the connector and the cover may be secured to the connector using a securing member.

23 Claims, 20 Drawing Sheets

ANGULAR CONNECTION SYSTEM FOR A LUMINAIRE

CROSS REFERENCE TO RELATED APPLICATION

This application claims priority to U.S. Provisional Application No. 62/237,935 filed on Oct. 6, 2015. The above referenced application is incorporated by reference in its entirety.

BACKGROUND

Luminaires may come in a variety of sizes and shapes. Some luminaires may include housings or lighting fixtures, allowing the housing and/or fixtures to be manufactured in sections and then later assembled into a final fixture assembly or luminaire that can be a different length or shape. The housings of these light fixtures are typically connected together to create these different length and shaped luminaires. However, the assembly of the light fixtures to form a corner joint or other angled joint can be difficult and time consuming, especially if several housings need to be connected together. An angular joint connection system that can easily align and connect the light fixtures together can decrease the time required connect the light fixtures together. Additionally, an angular joint connection system is desired that will provide an aesthetically-pleasing look that provides a hidden, concealed, and seamless connection. An angular joint system is also desired that provides a consistent alignment of the housing(s) at the angular joints, providing no gaps or visible joint seams or fasteners.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting light fixtures to form a simple corner joint comprising an outer piece, or cover, and an inner piece, or connector, that slide together. A connection system for a luminaire may comprise: a cover having a base wall, a first side wall, a second side wall, and a plurality of guides, where the first side wall and the second side wall of the cover are connected to form an angle; a connector having a top surface, a bottom surface, a first side wall, a second side wall, and a plurality of guides, where the plurality of guides of the cover engages the plurality of guides of the connector. The cover may be slidably engaged onto the connector and the cover may be secured to the connector using a securing member. The cover may also have a protrusion on the base surface and the connector may have a recess on the bottom surface that receives at least a portion of the protrusion on the base surface of the cover. The cover may further comprise a plurality of exterior surfaces that are smooth and free of any features. The securing member may be a mechanical fastener and the securing system of the cover may comprise at least a portion of female threads Another aspect of this invention relates to a plurality of guides on both the cover and the connector. The guides of the cover may be positioned along a first edge of the first side wall and a second edge of the second side wall and may include a first surface and a second surface that are parallel.

Also, the guides of the connector may include a first surface and a second surface that are parallel.

A further aspect of this invention relates to a connector where the connector may further comprise a first slot extending through a portion of the top surface, the first side wall, and the second side wall and a second slot extending through a portion of the first side wall and the second side wall, wherein a centerline of the first slot and a centerline of the second slot are coplanar.

BRIEF DESCRIPTION OF THE DRAWINGS

The present invention is illustrated by way of example and not limited in the accompanying figures in which like reference numerals indicate similar elements and in which.

Figure 1:
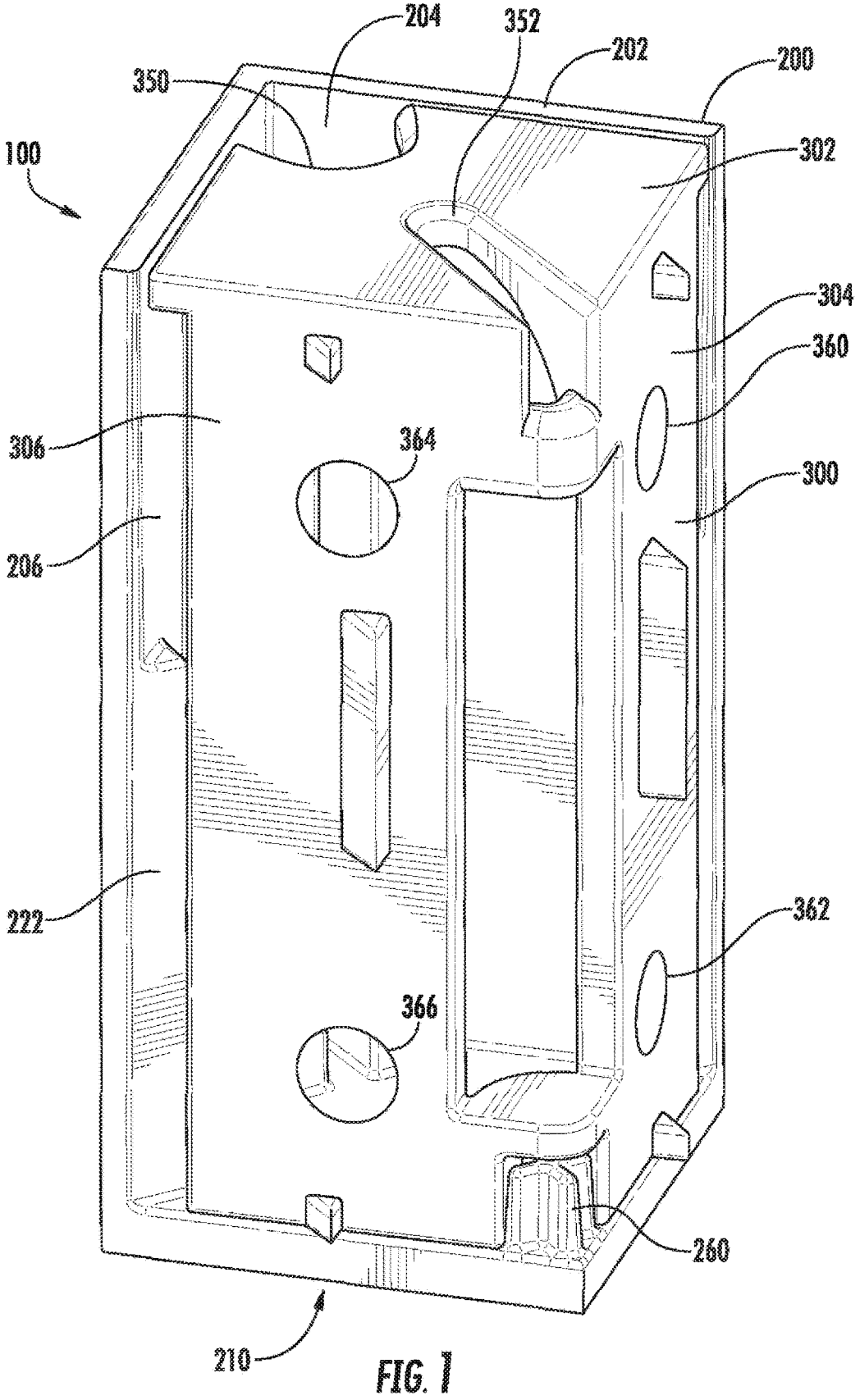
FIG. 1 illustrates an top front perspective view of an example embodiment of a connection system according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Generally perpendicular" means that a first line, segment, plane, edge, surface, etc. is approximately (in this instance, within 5%) oriented approximately 90 degrees from another line, plane, edge, surface, etc., over at least 50% of the length of the first line, segment, plane, edge, surface, etc.

"Plurality" indicates any number greater than one, either disjunctively or conjunctively, as necessary, up to an infinite number.

"Substantially constant" when referring to a dimension means that a value is approximately the same and varies no more than +/−5%.

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

In general, as described above, aspects of this invention relate to a structure and system for connecting the housings of lighting fixtures to enable easy installation of the housings of the lighting fixtures to create or form various shapes or patterns. More detailed descriptions of aspects of this invention follow.

One aspect of this invention relates to a connection system 100 for creating a directional change when assembling various lighting fixtures or portions of lighting fixtures together. Such systems may include, for example a cover 200 and a connector 300 which receives at least a portion of the cover 200. The cover may generally include a base surface 208 having a protrusion 260, a first side wall 204, a second side wall 206, and a plurality of guides 220, 222. The first side wall 212 and the second side wall 214 may be connected. The connector 300 may include a bottom surface 316 having a recess 340 for receiving at least a portion of the protrusion 260 of the cover 200, a first side wall 304, a second side wall 306, and a top surface 302.

Figure 2:
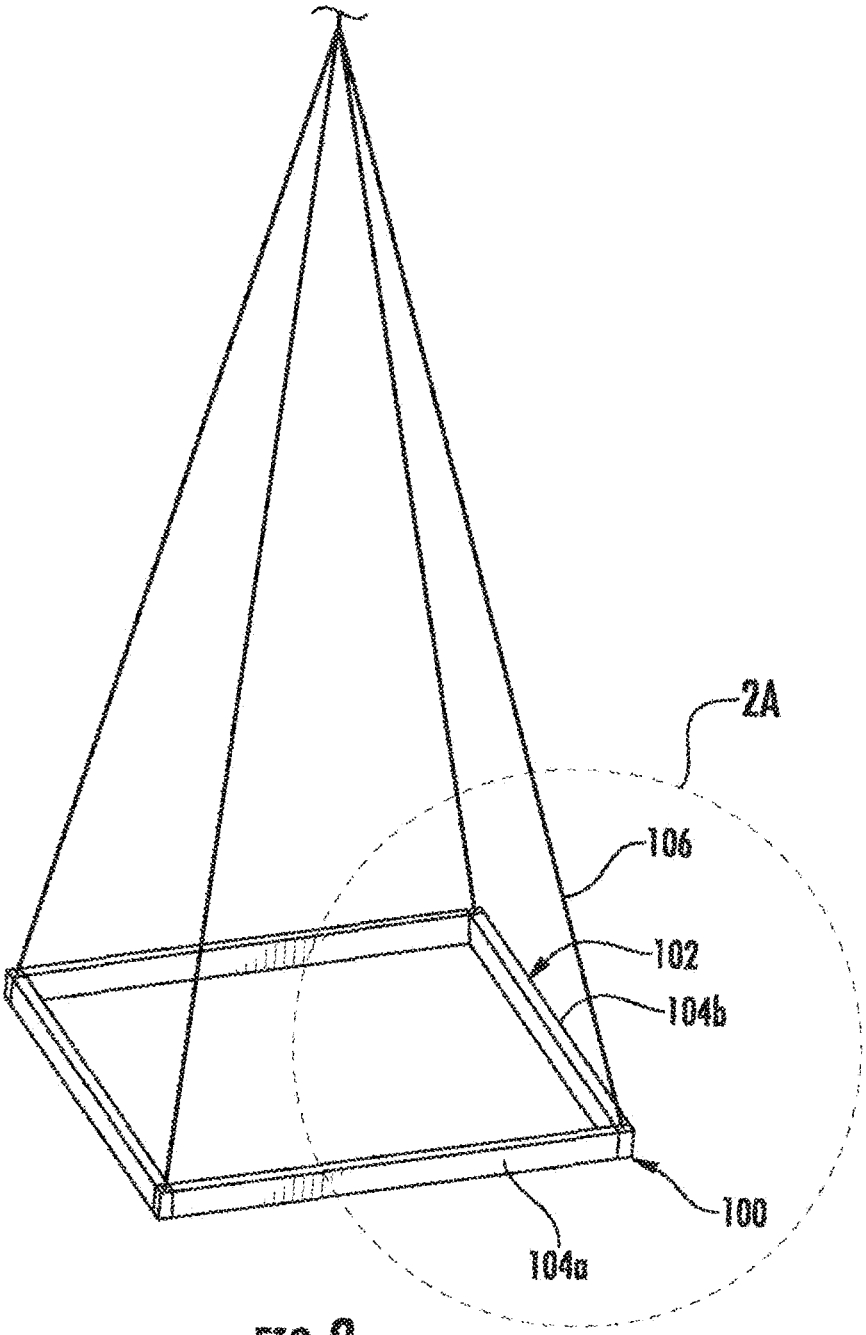
FIGS. 2 and 2A illustrate a top front perspective view of an example embodiment of a lighting assembly using an embodiment of the connection system according to one or more aspects described herein.
Figure 2A:
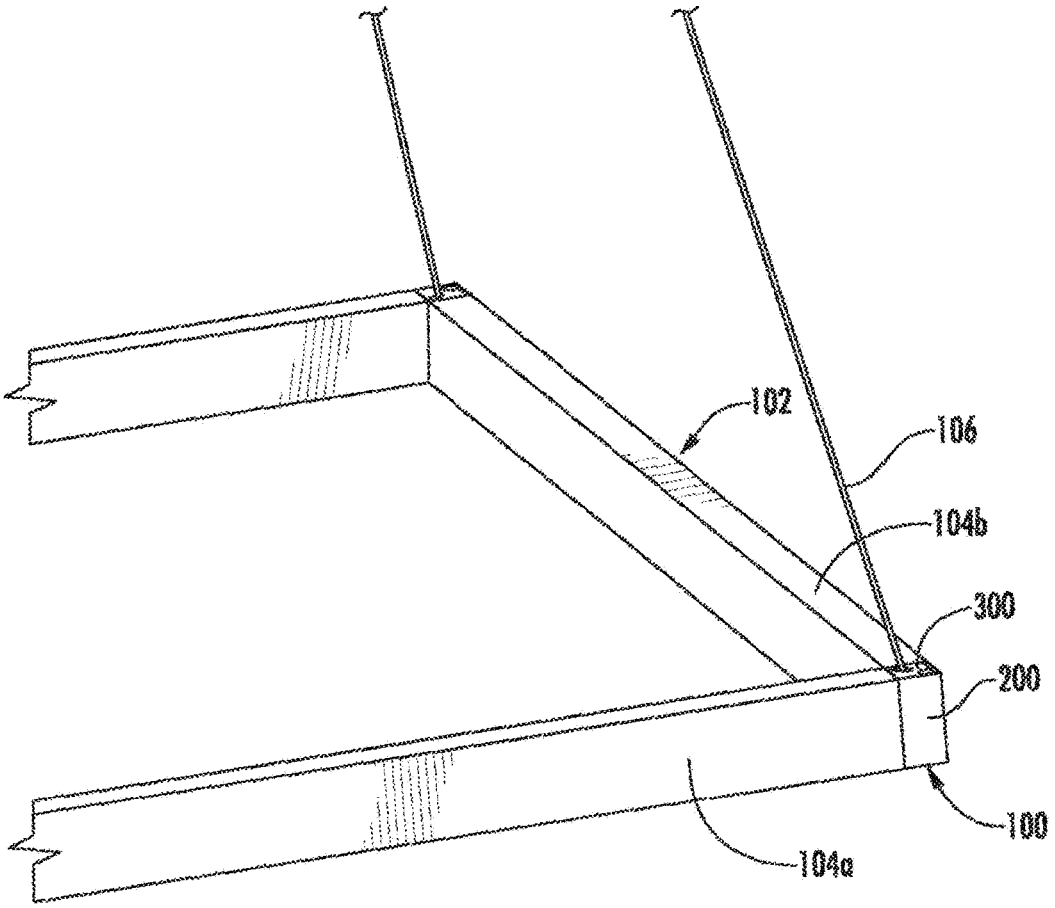
Figure 3:
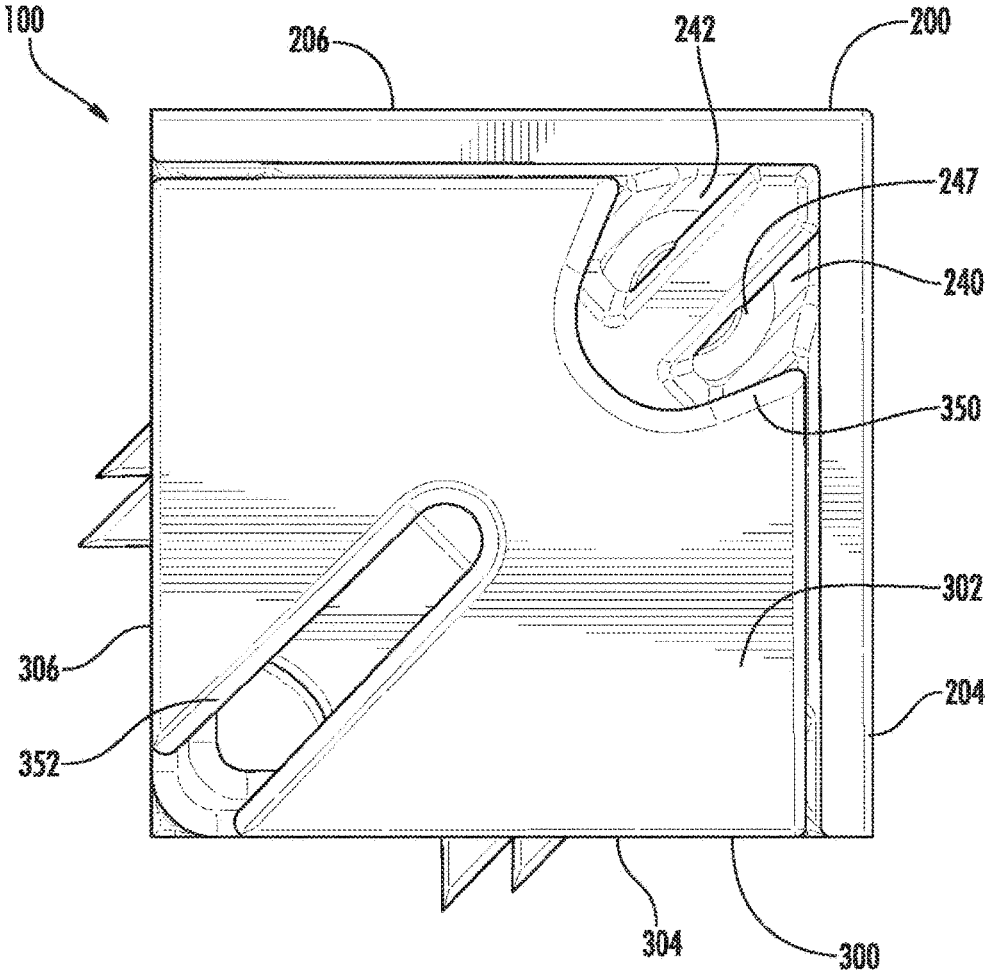
FIG. 3 illustrates a top view of the example embodiment of the connection system of FIG. 1.

FIG. 1 shows a perspective view of an example embodiment of the connection system 100. The connector 300 is nested within the cover 200 such that the connector is not visible except from the top when the connection system 100 is connected to the luminaire. The connection system 100 may be primarily used for a creating a corner or direction change. The example embodiment of the connection system 100 shown in FIG. 1 creates a corner that is at a right angle to create a square or rectangular luminaire 102 as shown in FIGS. 2 and 2A, although the corner may be any angle to create the desired lighting design. Additionally, the connection system 100 may be used in a circular or arc shaped luminaire to connect two curved or arc-shaped housings.

Figure 1A:
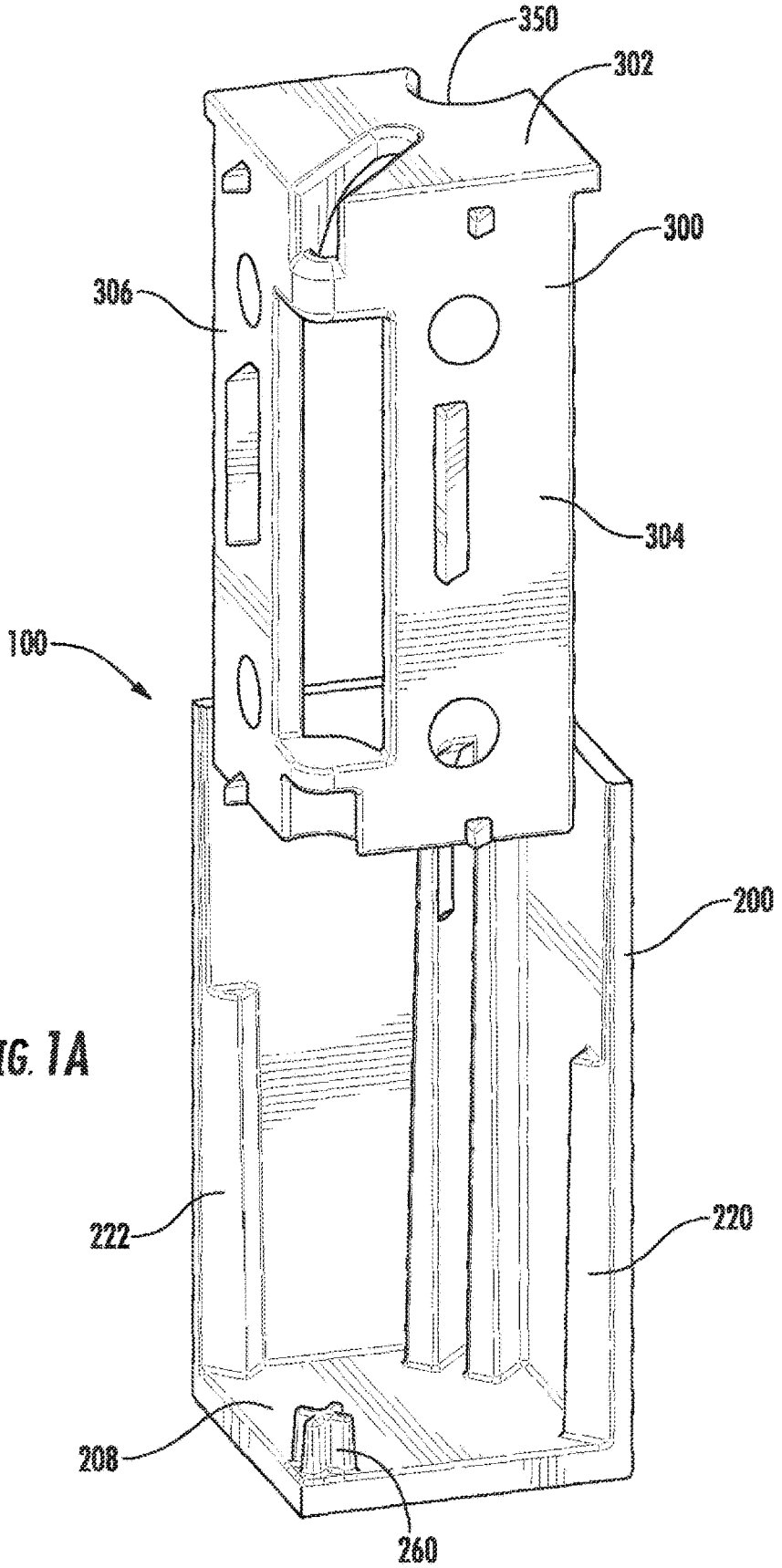
FIG. 1A illustrates a top front perspective view of the example embodiment of the connection system of FIG. 1 in a partially assembled state.

The cover 200 and the connector 300 may be slidably engaged as shown in FIG. 1A. The connector 300 may be assembled to a housing 104 of the light fixture of the luminaire 102. The housing 104 may include one or more side housings 104*a*, 104*b*. The cover 200 may be connected by sliding the cover 200 over the connector 300 in a vertical direction (or a direction generally perpendicular to a bottom surface 316 of the connector 300), thereby connecting a first side housing 104*a* and a second side housing 104*b*. A base surface 208 of the cover 200 may be in communication with the bottom surface 316 of the connector 300.

Both the cover 200 and connector 300 may have a plurality of guides to properly align the cover 200 to the connector 300. For example, the cover 200 may have a plurality of guides 220, 222 in communication with a plurality of guides 308, 312 of the connector 300. More specifically, front surface 228 of guide 220 may confront front surface 314 of guide 308, and front surface 230 of guide 220 may confront front surface 310 of guide 312.

The connector 300 may have a recess 340 on the bottom surface 316 that receives at least a portion of the protrusion 260 located on the base surface 208 of the cover 200 when the cover 200 is engaged with the connector 300 to ensure the proper alignment and prevent rotation of the cover 200 with respect to the connector 300 in a direction different than the rotation prevented by the plurality of guides 220, 222, 308, 312. The cover 200 may be secured to the connector 300 via a securing member (not shown) such as a mechanical fastener installed through opening 350 of connector 300 into the securing structure 247 of cover 200.

Cover

Figure 4:
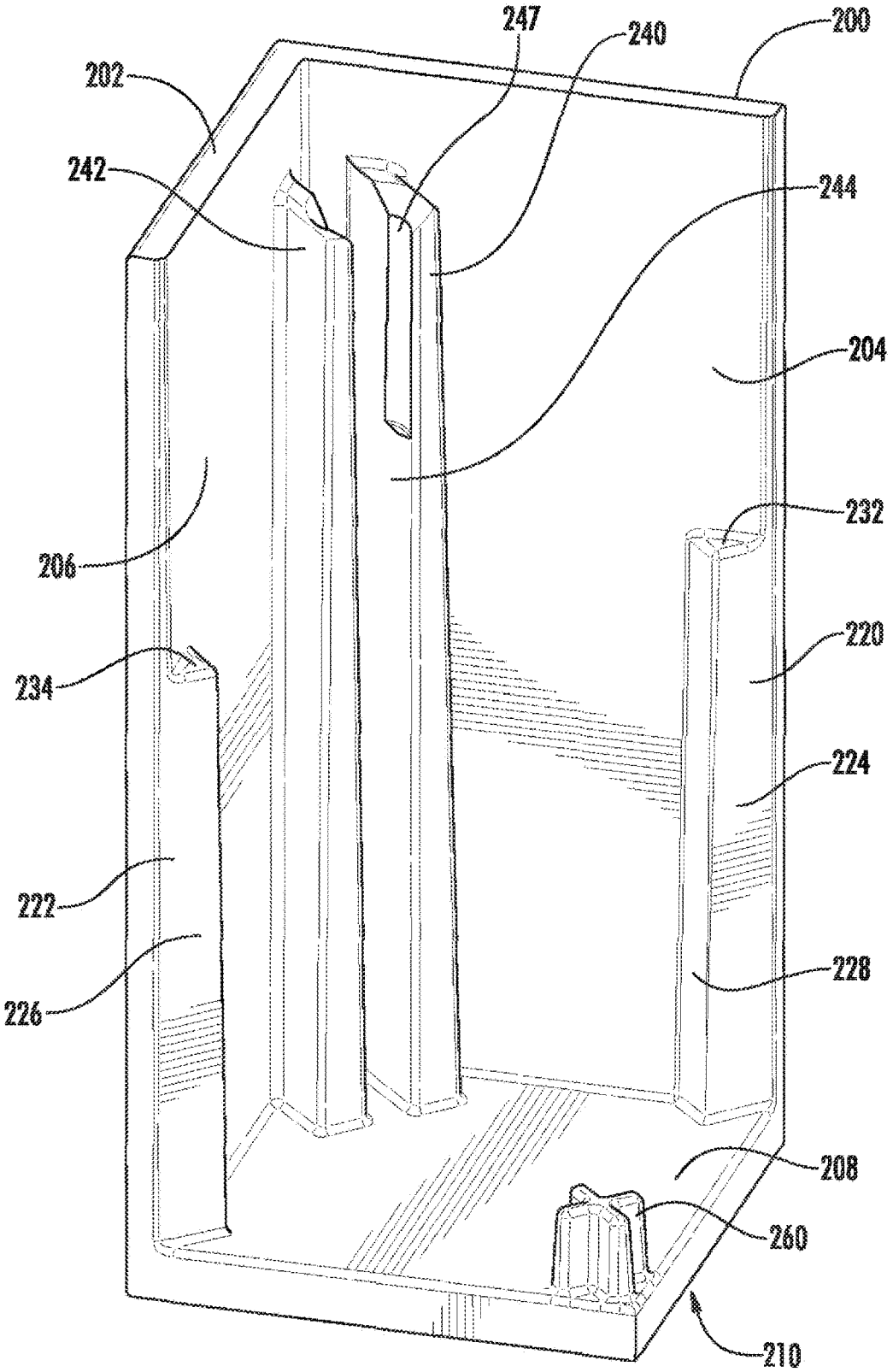
FIG. 4 illustrates a top front perspective view of one of the components of the connection system of FIG. 1.
Figure 5:
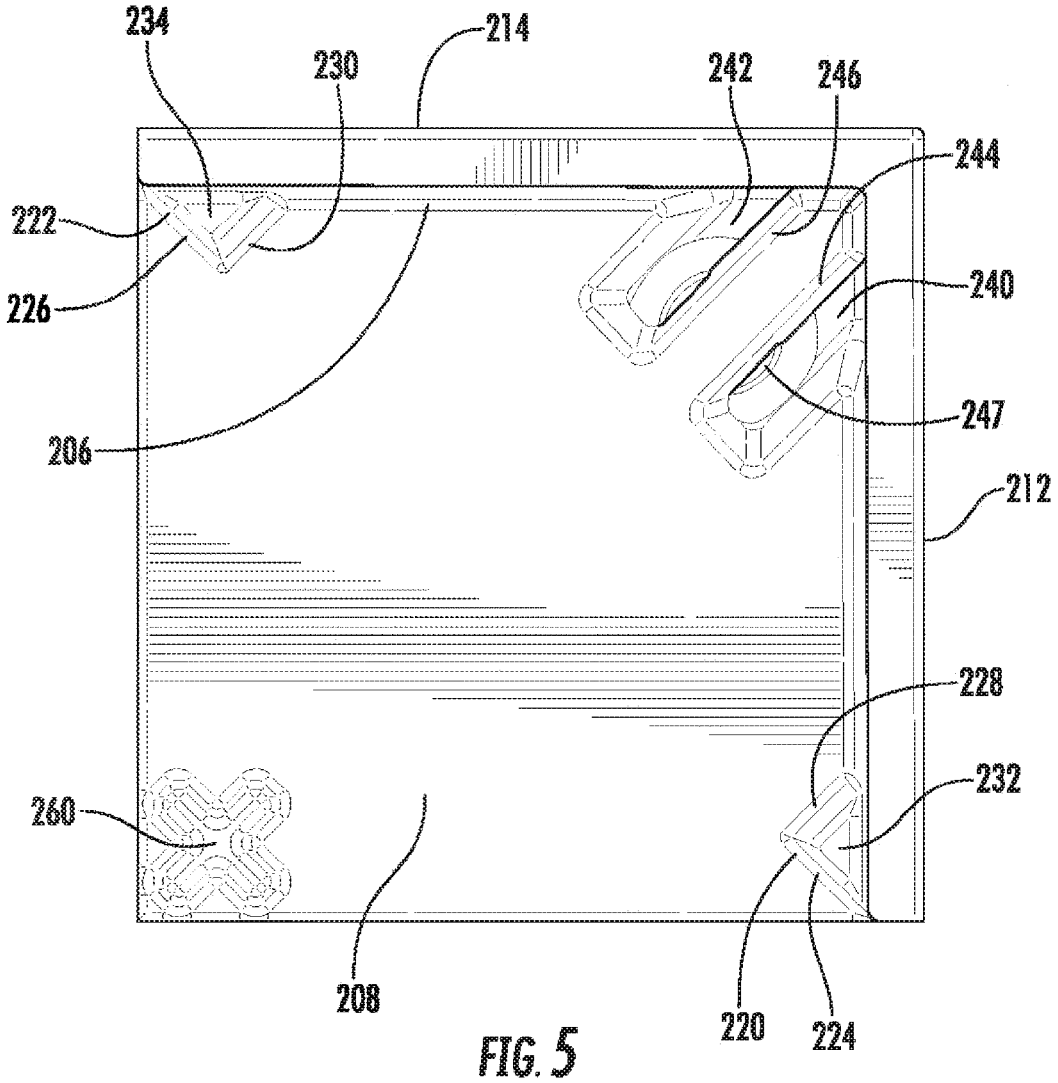
FIG. 5 illustrates a top view of the component of FIG. 4.
Figure 6:
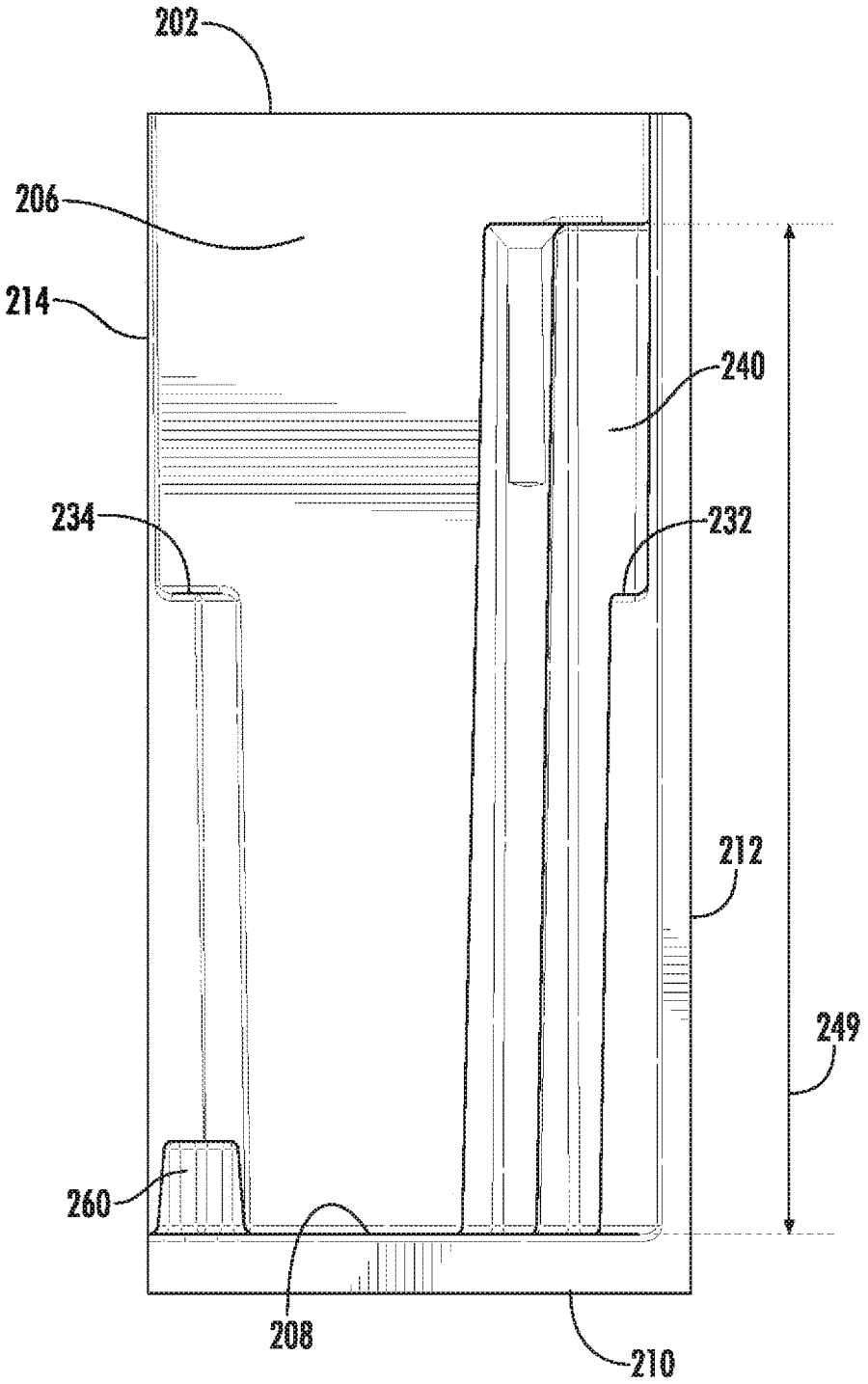
FIG. 6 illustrates a side view of the component of FIG. 4.

The cover 200 shown in FIGS. 4-6 may comprise a top surface 202, a first side wall 204, a second side wall 206, a base surface 208, and a bottom surface 210 opposite the base surface 208. The side walls 204, 206 may be generally perpendicular to the base surface 208. The first side wall 204 and the second side wall 206 may be connected to form an angle and may have a substantially constant thickness. While the example embodiment in FIGS. 4-6 shows a cover with two side walls 204, 206, the cover 200 may have any number of side walls, such as one, three, four, five, six, or more side walls.

As discussed above, the side walls 204, 206 connect to form an angle. For example, in FIGS. 4-6, the side walls 204, 206 may be generally perpendicular forming a 90 degree angle. Alternatively, the side walls 204, 206 may form an obtuse angle or an acute angle.

The cover 200 may have a plurality of guides 220, 222 positioned along the side walls to help align the connector 300. The guides 220, 222 may comprise top surfaces 232, 234, front surfaces 224, 226, and side surfaces 228, 230 respectively. The guides 220, 222 may be positioned along an edge 221, 223 of the side walls 204, 206 opposite the edge formed where the side walls connect. The guides 220, 222 may extend from the base surface 208 along the edges 221, 223. The front surfaces 228, 230 and side surfaces 224, 226 of each guide 220, 222 may be generally perpendicular to each other. Additionally, the front surfaces 228, 230 may be generally parallel to each other. Alternatively, the front surfaces 228, 230 may not be generally parallel and may be generally perpendicular to each other, or may form any angle. The side surfaces 224, 226 may be coplanar. A variety of guides and systems may be used without departing from this invention including guides that are asymmetrical having a differently shaped guide on the first side wall 204 than on the second side wall 206.

Additionally, the guides 220, 222 may extend along any portion of an overall length of the cover 200 measured from the top surface 202 to the bottom surface 210 without departing from this invention. The guides 220, 222 may have the same length or alternatively may have different lengths. Further the guides 220, 222 may have a length larger than the height of the protrusion 260.

Additionally, the cover 200 may have a protrusion 260 extending generally perpendicular to the base surface 208 to assist in aligning the cover 200 to the connector 300. The protrusion 260 may have a cross-sectional shape that is symmetrical about at least one plane. For instance, the protrusion 260 may have any cross-sectional shape such as a circle, a square, a cross, a star, or a t-shape as shown in example embodiment of FIGS. 4 and 5. Additionally, the outer surfaces of the protrusion 260 may have a taper such that the cross-sectional shape becomes smaller in size as the protrusion 260 extends away from the base surface 208. Alternatively, the exterior surfaces of the protrusion 260 may not have a taper.

The cover 200 may further comprise a plurality of ribs 240, 242 positioned proximate the joint formed from the connection of the side walls 204, 206. The ribs 240, 242 may have interior surfaces 244, 246 facing each other and spaced a distance to allow for a securing structure 247 to have a portion within each rib 240, 242. Alternatively, the ribs 240, 242 may be a single entity such that the securing structure 247 is positioned within that single entity.

While a variety of different securing structures 247 may be used without departing from this invention, in some example structures according to this invention, the securing structure may include a portion of a threaded hole defined in the top surfaces of ribs 240, 242. Alternatively, the securing structure 247 may include a mechanical fastening system, such as, but not limited to a full threaded hole, tapered surfaces, holes sized for press fits or any mechanical fastening system.

The cover may have a plurality of exterior surfaces 210, 212, 214 that have a smooth surface free of any features to provide the desired aesthetic appearance. Alternatively, the exterior surfaces 210, 212, 214 may have a textured or patterned surface finish.

Connector

The connector 300 shown in FIGS. 7-11 may comprise a top surface 302, a plurality of side walls 304, 306, and a bottom surface 316 where the side walls 304, 306 may be generally perpendicular to the top surface 302. The first side wall 204 and the second side wall 206 may be connected to form an angle and may have a substantially constant thickness. While the example embodiment in FIGS. 7-11 shows a connector with two side walls 304, 306, the connector 300 may have any number of side walls, such as three, four, five, six or more side walls.

As discussed above, the side walls 304, 306 may be connected to form an angle. The side walls 304, 306 may be generally perpendicular forming a 90 degree angle. Alternatively, the side walls 304, 306 may form an obtuse angle or an acute angle. The angle between the first and second side walls 304, 306 of the connector 300 may be the same as the angle between the first and the second side walls 204, 206 of the cover 200.

The connector 300 may have a recess 340 on the bottom surface 316. The recess 340 may be positioned proximate the corner formed by the connection of side walls 304, 306. The recess 340 may be partially cylindrical in shape open to the exterior having a rounded surface 346 and a top surface 347. Alternatively, the recess 340 may be a full cylindrical shape or any shape where only the top surface 347 is open to the exterior.

Figure 7:
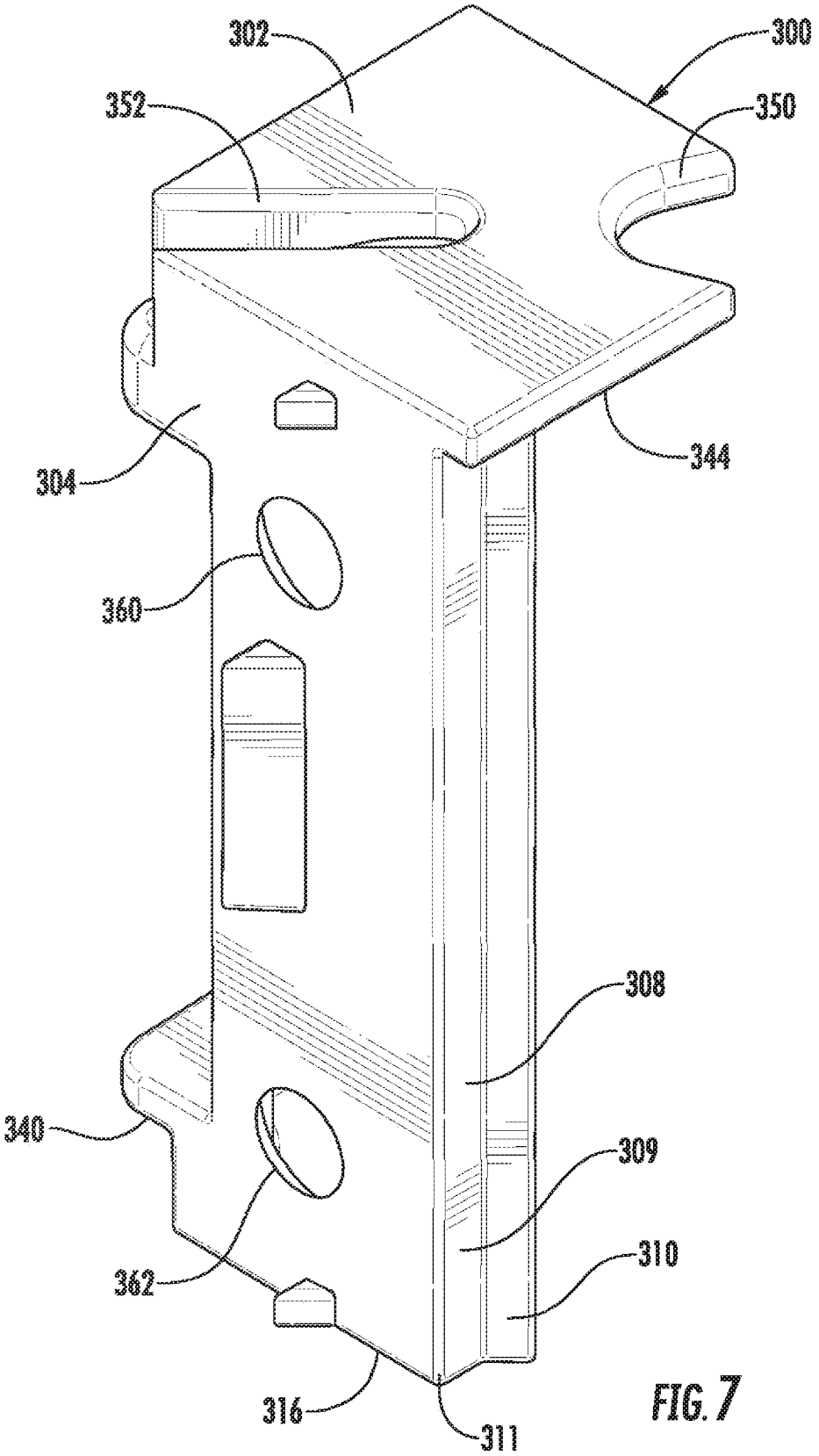
FIG. 7 illustrates a top front perspective view of one of the components of the connection system of FIG. 1.
Figure 8:
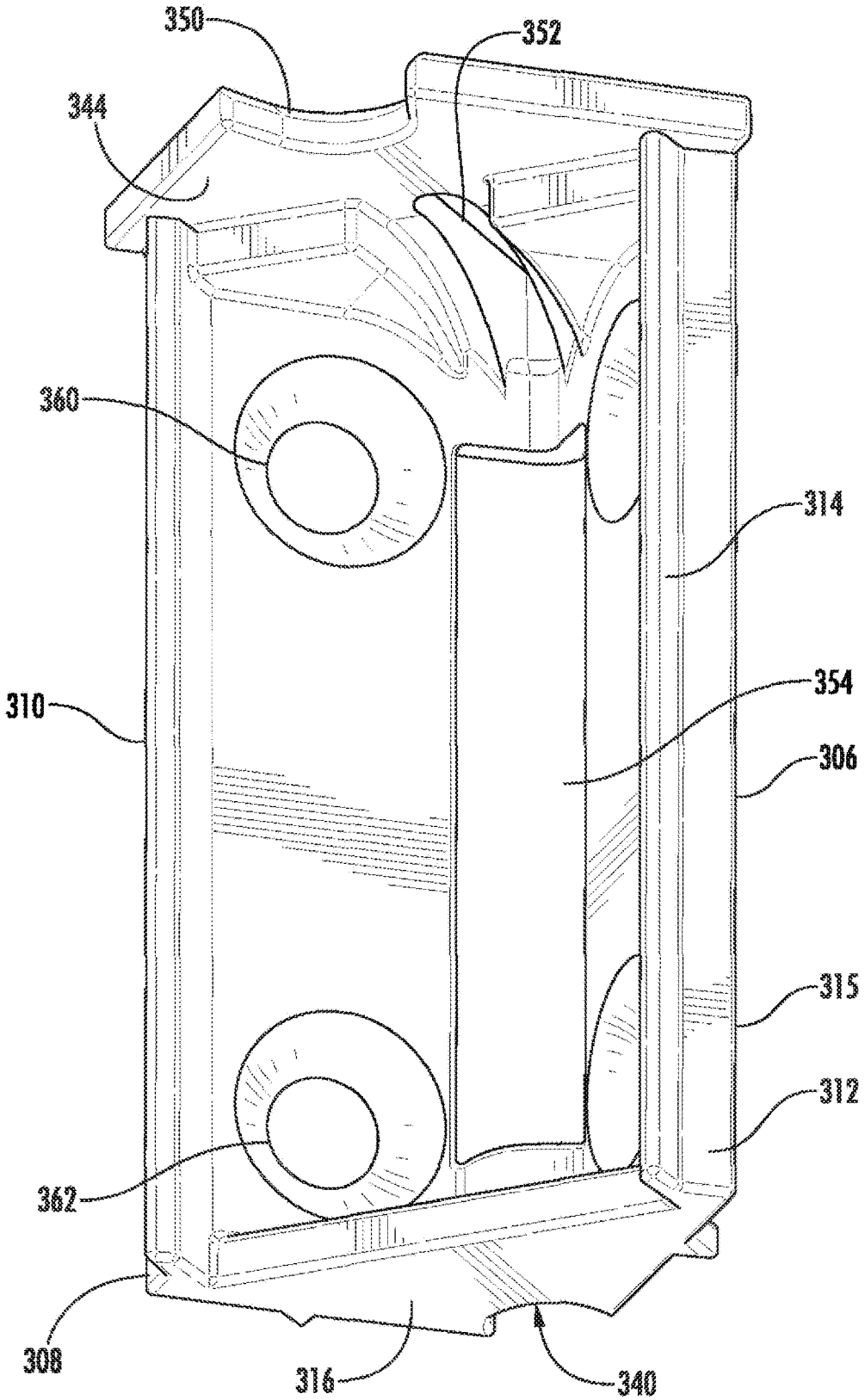
FIG. 8 illustrates a back left perspective view of the component of FIG. 7.
Figure 9:
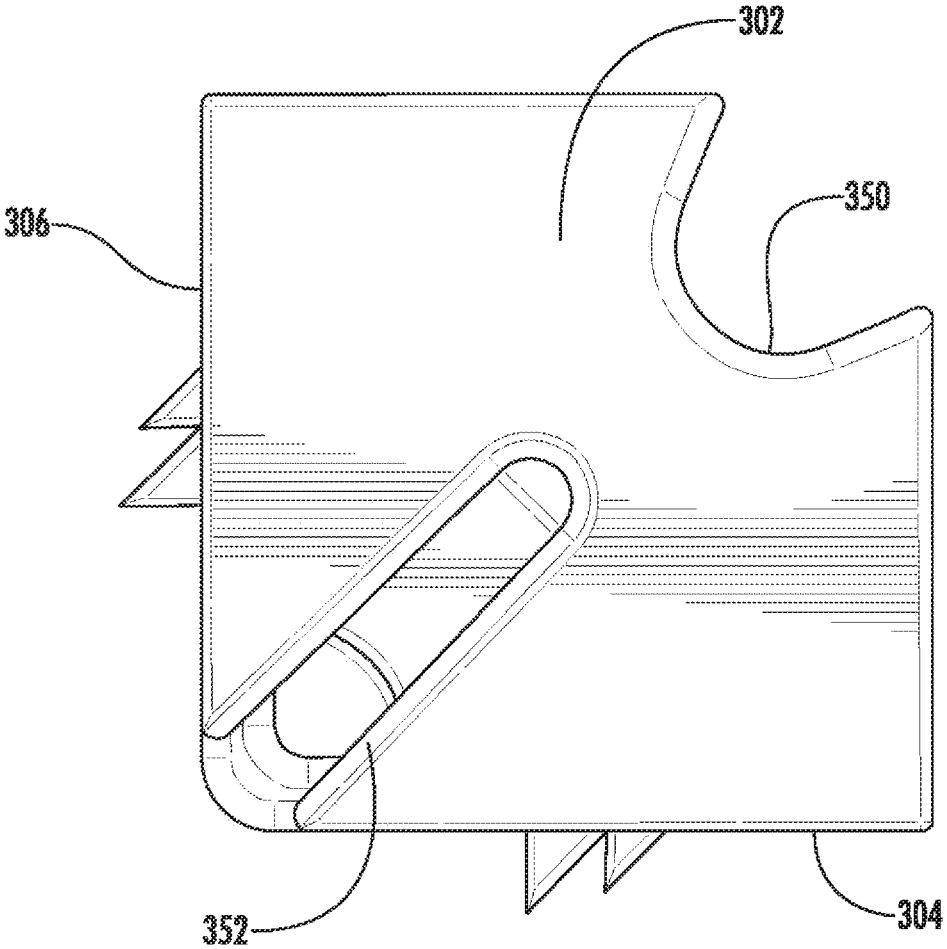
FIG. 9 illustrates a top view of the component of FIG. 7.
Figure 10:
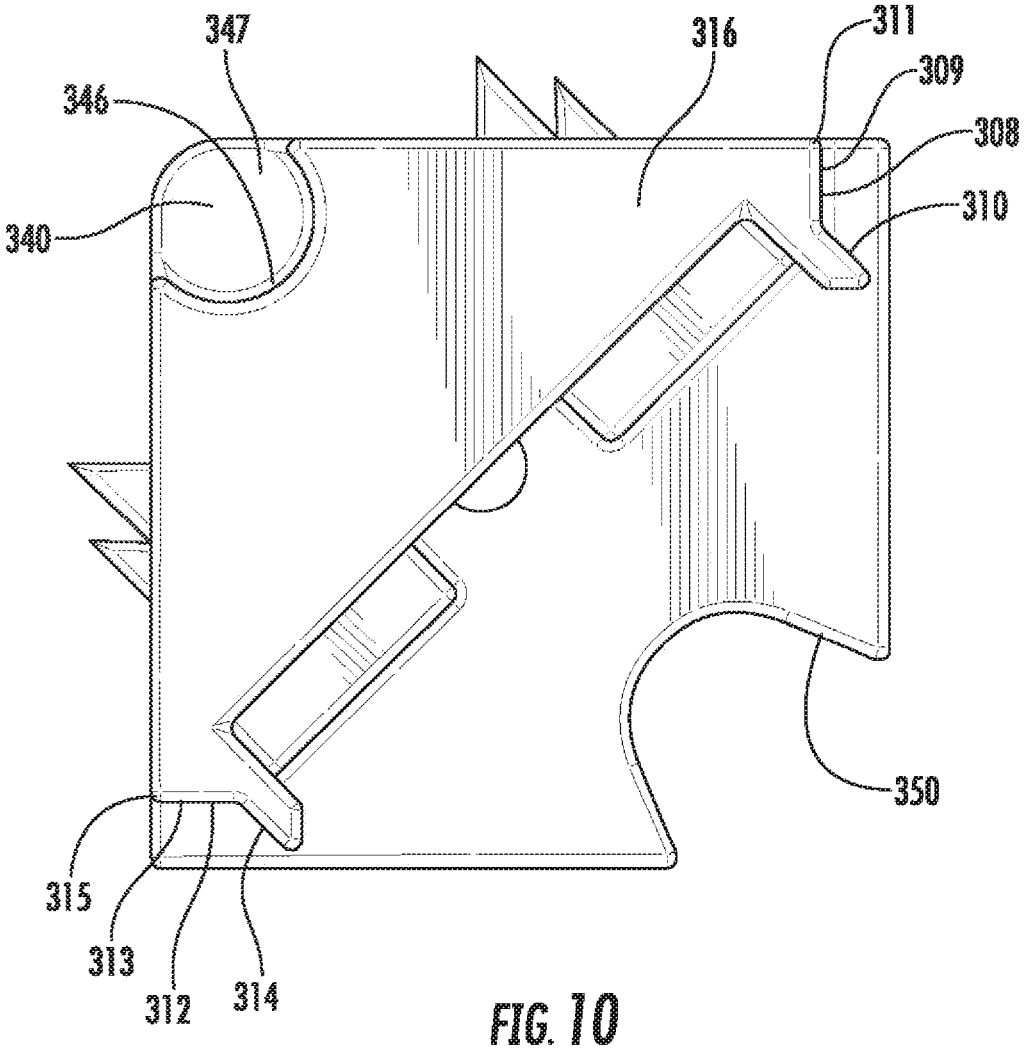
FIG. 10 illustrates a bottom view of the component of FIG. 7.
Figure 11:
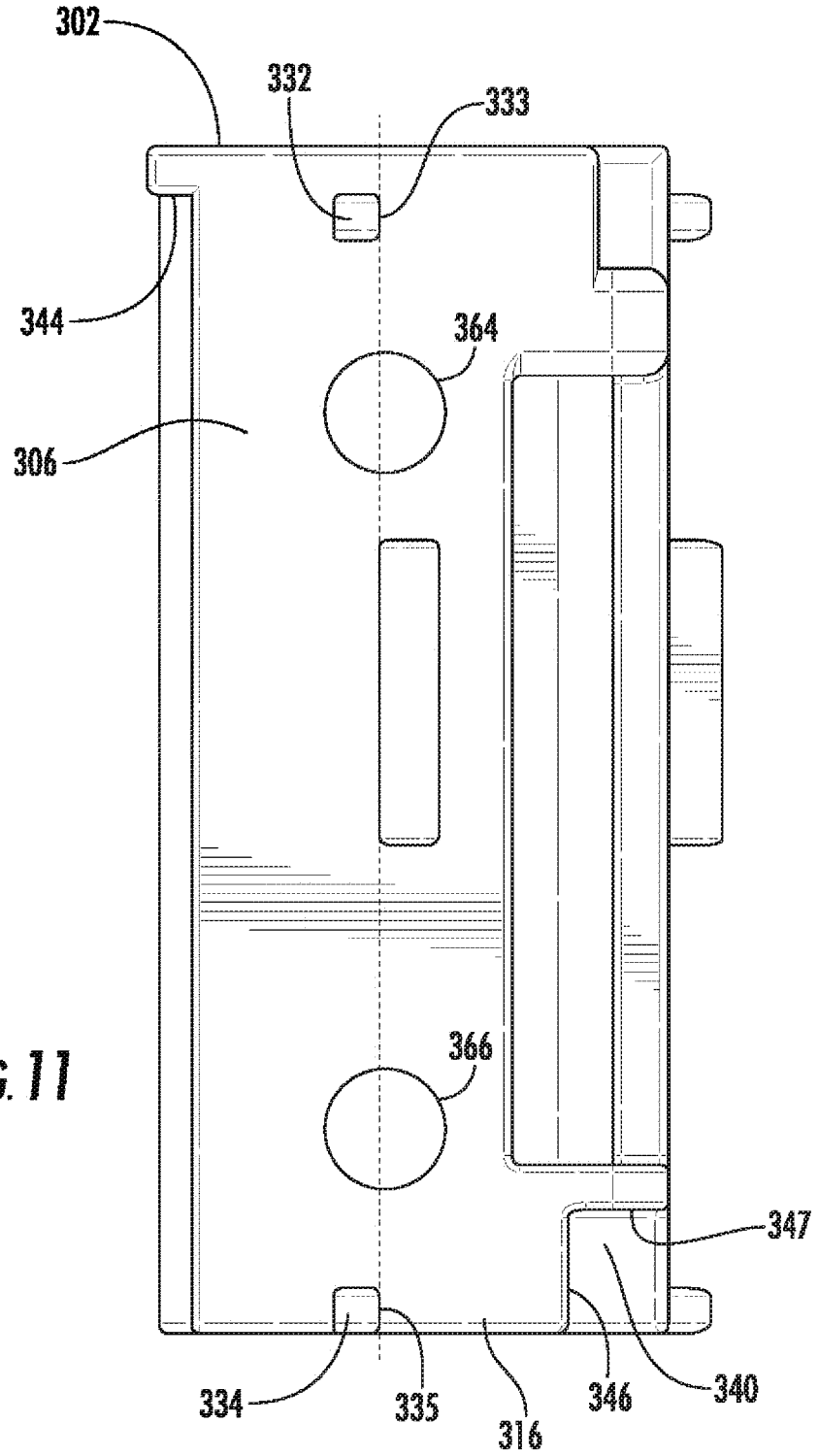
FIG. 11 illustrates a front view of the component of FIG. 7.

As shown in FIGS. 7, 10, and 11, the connector 300 may have a plurality of guides 308, 312 positioned along the side walls to help align the connector 300 with the cover 200. The guides 308, 312 may comprise front surfaces 310, 314 and side surfaces 309, 313 respectively. The guides 308, 312 may be positioned along an edge 311, 315 of the side walls 304, 306 opposite the edge formed where the side walls connect. The guides 308, 312 may extend from the interior surface 344 opposite the top surface 302 along the edges 311, 315. The front surfaces 310, 314 and side surfaces 309, 313 of each guide 308, 312 may form an obtuse angle between them. Additionally, the front surfaces 310, 314 may be generally parallel to each other. Alternatively, the front surfaces 310, 314 may not be generally parallel. Also, the side surfaces 309, 313 may be generally perpendicular to their respective side walls 304, 306. Similarly, the side wall 309 may also be generally perpendicular to side wall 313. While the embodiment shown in FIGS. 7-11 shows two guides 308, 312, the cover 300 may have any number of guides. A variety of guides and systems may be used without departing from this invention including guides that are asymmetrical having a differently shaped guide on the first side wall 304 than on the second side wall 306.

Additionally, the guides 308, 312 may extend the entire length from the interior surface 344 to the bottom surface 316. Alternatively, the guides 308, 312 may have a length defined as a percentage of the length from the interior of the top surface 344 to the bottom surface 316. Each guide 312, 314 may have the same length or alternatively may have different lengths.

The connector 300 may have a shape that is substantially open opposite the corner formed by the side walls 304, 306 to allow for cabling and interconnection of the different light fixtures. Each side wall 304, 306 may have the same length when measured in the cross-section. Additionally, the connector 300 may have a bottom surface 316 that is substantially smaller than the top surface 302. In the exemplary embodiment shown in FIGS. 7-11, the connector 300 may have a cross-sectional shape, similar to the cross-sectional shape for connector 300 which is generally "L-shaped" for a cross-section taken parallel to the top surface 302 at a midpoint of its overall height measured from the top surface 302 to the bottom surface 316. The bottom surface 316 may have a surface area that is less than half of the surface area of the top surface 302.

Further, the connector 300 may have a slot 352 to allow for a mounting cable 106 of the luminaire 102. Additionally, a power cable 108 may be electrically connected to the mounting cable 106. The slot 352 may extend through a plurality of surfaces and may have a length sufficient for supporting a mounting cable 106 entering the connector 300 at a variety of angles. For example, as shown in FIGS. 1, 2A, 7, and 8, the slot 352 extends through a portion of the top surface 302 and side walls 304, 306. Alternatively, the slot 352 may extend through only a portion of the top surface 302. The slot 352 may have rounded edges to avoid any sharp corners contacting any cables. Also, the slot 352 may have any shape and may be symmetric about a centerline or may be asymmetric about a centerline. The slot 352 may have a length greater than the width.

Additionally, a slot 354 may extend through a portion of both of the side walls 304, 306 between the top surface 302 and the bottom surface 316. Slot 354 may be positioned at the corner created where side walls 304, 306 connect. Slot 354 may have any length and any width. Similar to slot 352, slot 354 may have rounded edges to avoid any sharp corners contacting any cables. Slot 354 may have a centerline that is coplanar with a centerline of slot 352. Slot 354 provides an outlet for any power cables 108 entering through slot 352 to exit the connector 300 in any direction needed to connect to the cables of the light fixtures. Slot 354 may have any length or width. The slot 354 may have a symmetric shape about a centerline such that the portion extending through one side wall is the same size as the portion extending through the other side wall, or an asymmetric shape such that the portion extending through one side wall is larger than the portion extending through the other side wall.

Figure 12A:
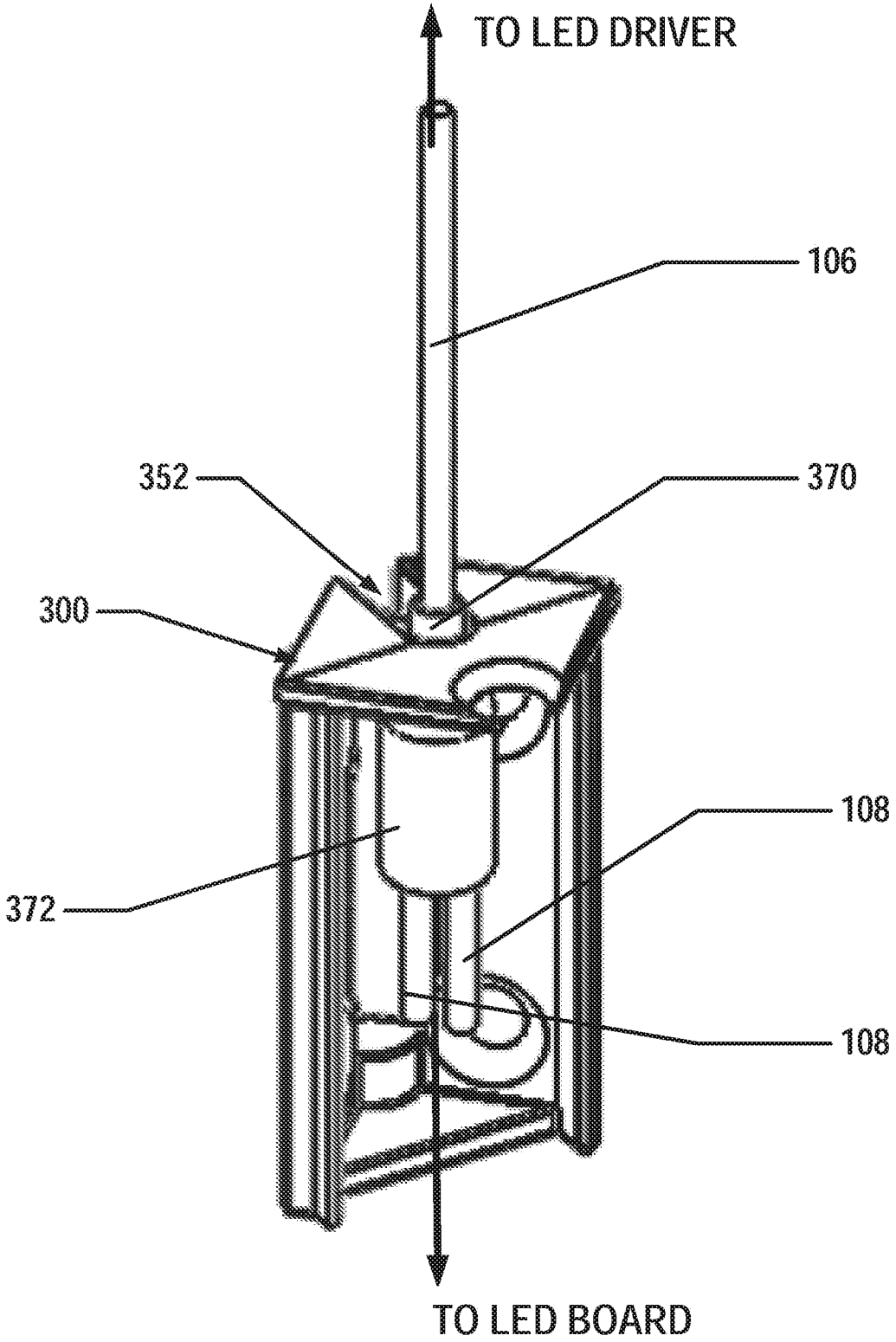
FIG. 12A illustrates a side view of the component of FIG. 7 with a mounting cable and a power cable.
Figure 12B:
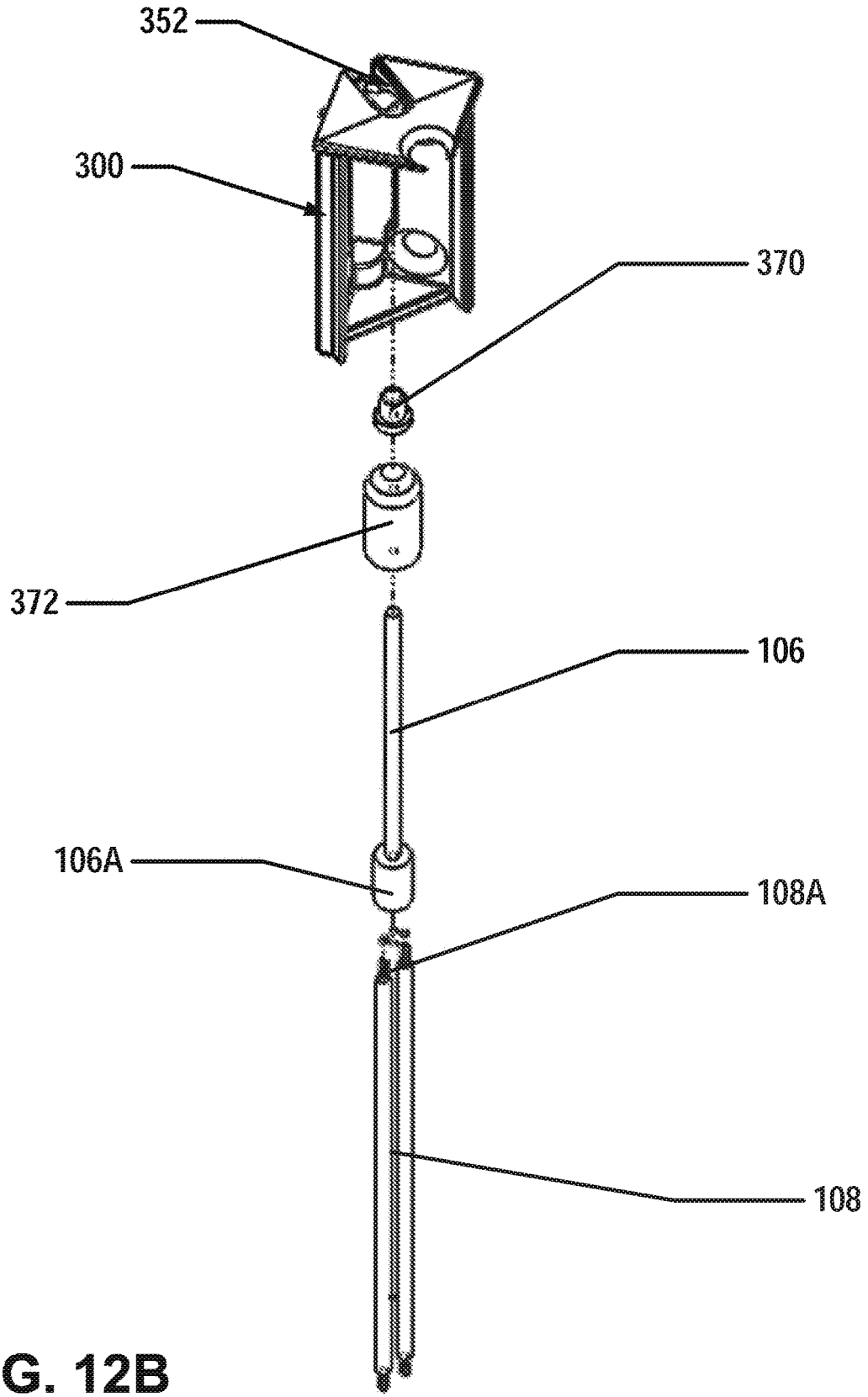
FIG. 12B illustrates an exploded view of the components of FIG. 12A.
Figure 13A:
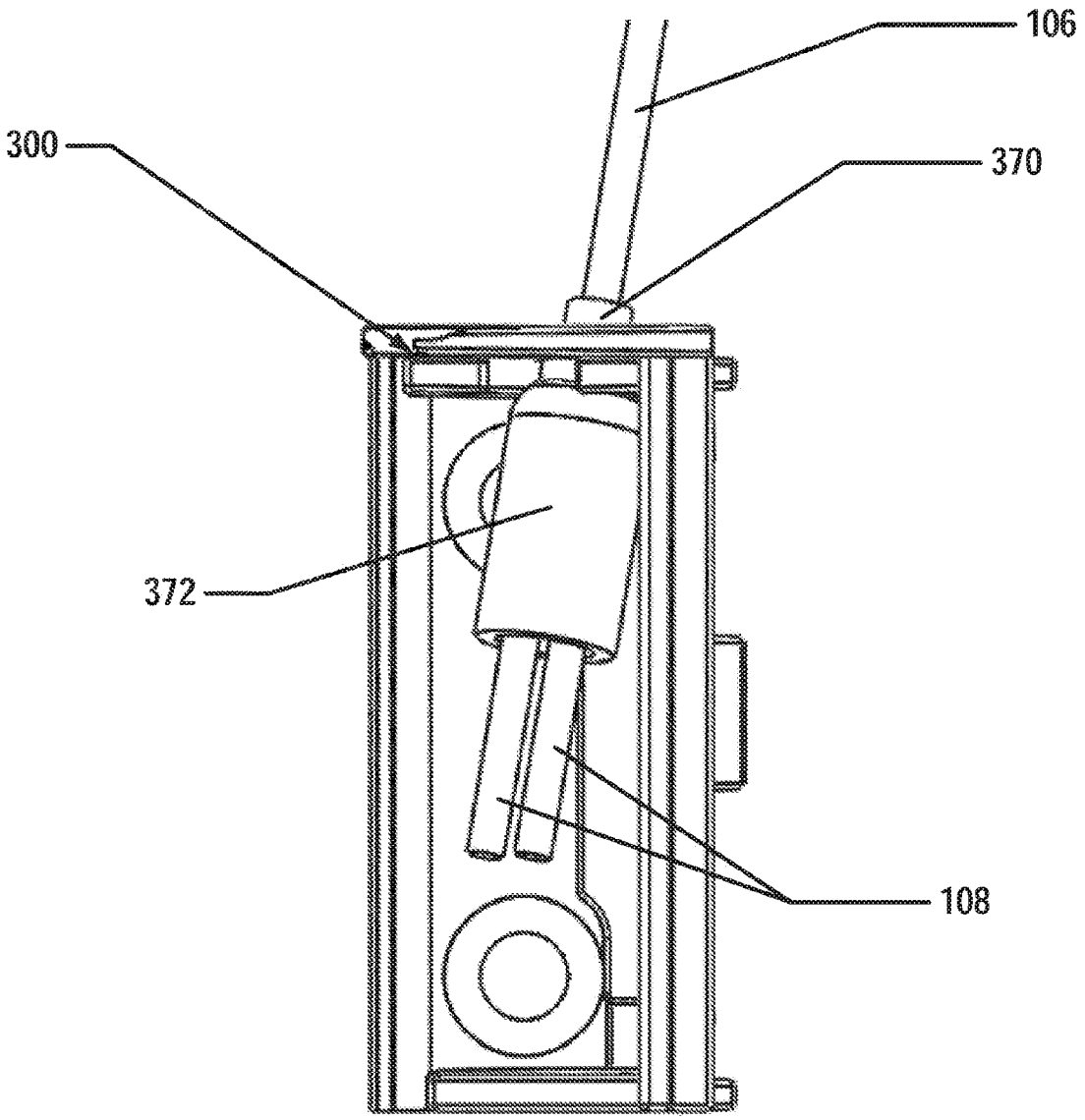
FIGS. 13A-13D illustrate various views of the components of FIG. 12A.
Figure 13B:
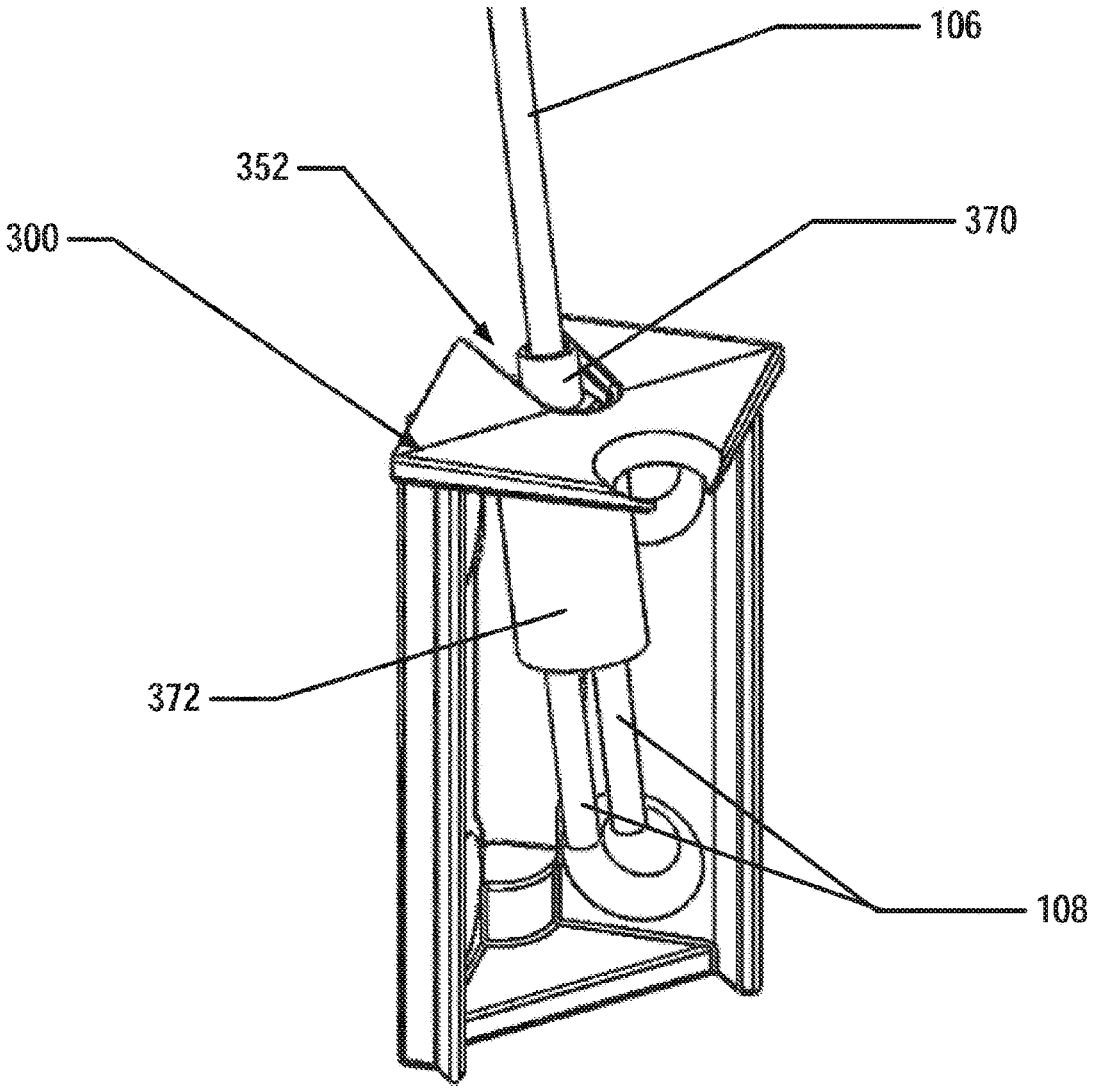
Figure 13C:
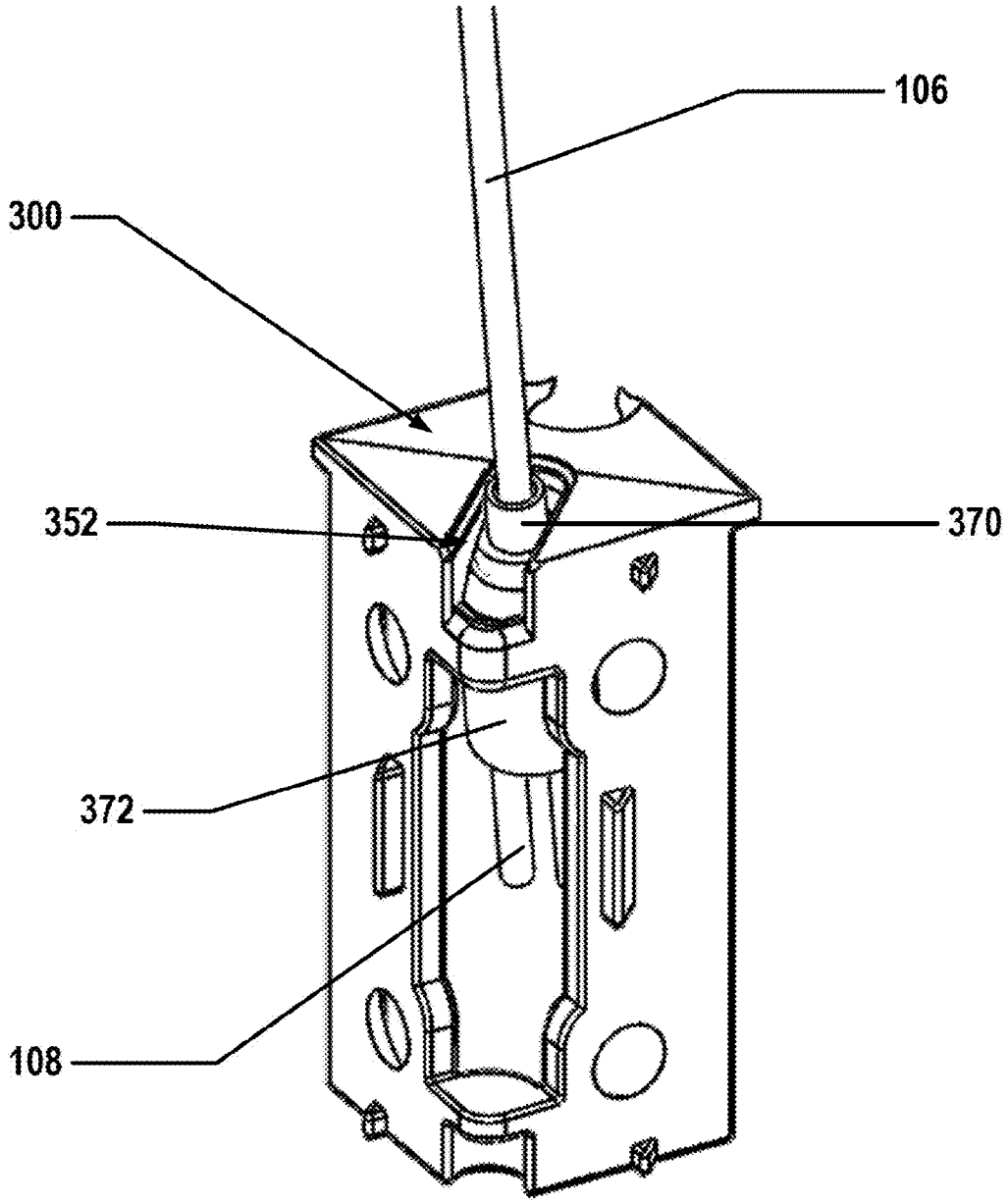
Figure 13D:
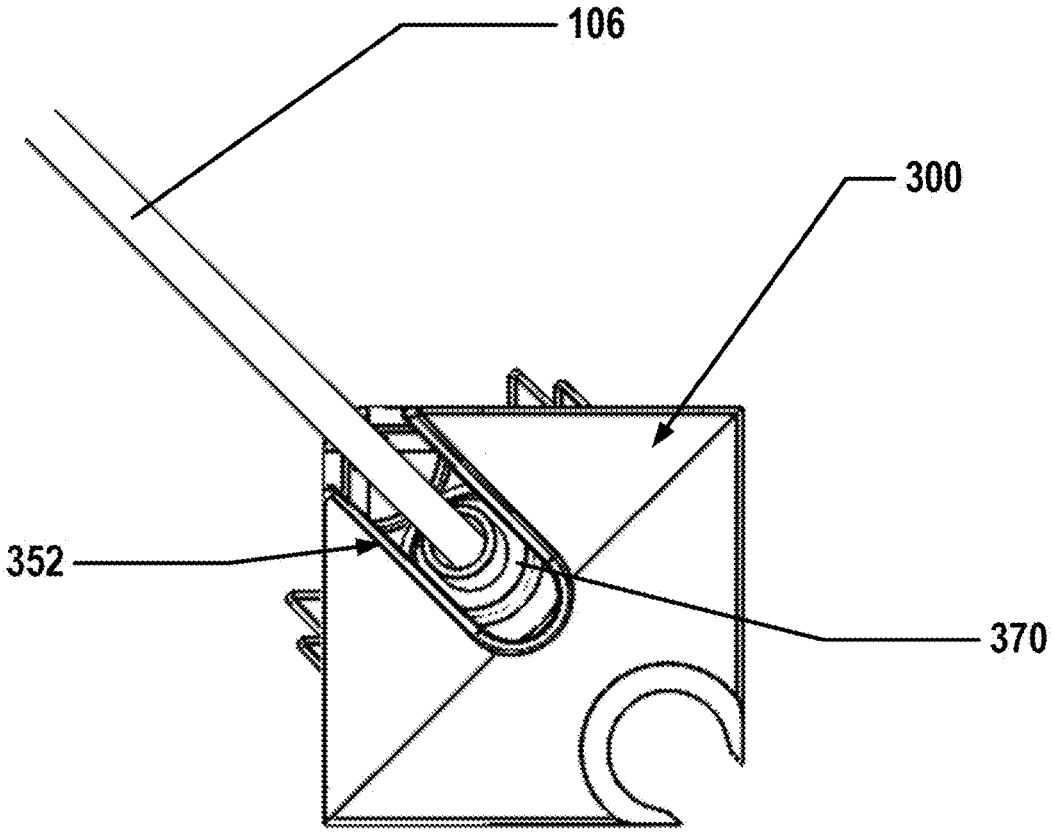

Additionally, FIGS. 12A-13D illustrate the electrical connection of the power cable 108 to the mounting cable 106 within the connector 300. FIG. 12A illustrates a side perspective view of the connector 300 with the mounting cable 106 electrically connected to the power cable 108. FIG. 12B illustrates an exploded side perspective view of the connector 300 from FIG. 12A showing each of the different components. As described above, the mounting cable 106 is utilized for both mounting the luminaire 100 to a ceiling or other structure and for carrying power to the luminaire 100. The mounting cable 106 may be an electrically conductive suspension cable from a power source, such as an LED driver. The mounting cable 106 may be electrically connected to the power cable 108 to provide power to a light source, such as an LED board on the luminaire 100. Other light sources may be utilized without departing from this invention. One or more power cables 108 may be utilized to provide power to one or more light sources or LED boards. FIGS. 12A-13D illustrate two separate power cables 108.

In one embodiment of the invention, the connector 300 may include an isolating bushing 370 located and positioned within the slot 352 of the connector 300. The isolating bushing 370 may be sized and shaped to pass the mounting cable 106 through a center hole while fitting within the slot 352. The isolating bushing 370 ensures no physical contact between an electrically charged mounting cable 106 and the sides of the connector 300, which may be made of metal. Without the isolating bushing 370, the electrically charged mounting cable 106 may be shorted out by the metal connector 300.

Further, as described above and illustrated in FIGS. 12A and 12B, the mounting cable 106 and the power cable 108 may be electrically connected by methods available and known and used in the art. As specifically illustrated in FIGS. 12A and 12B, the mounting cable 106 and the power cable 108 may be electrically connected via a soldered connection between an end 108A of the power cable 108 and an end 106A of the mounting cable 106. Additionally, an isolating sleeve 372 may be utilized to electrically isolate and protect the soldered electrical connection between the mounting cable 106 and the power cable 108.

Figure 14A:
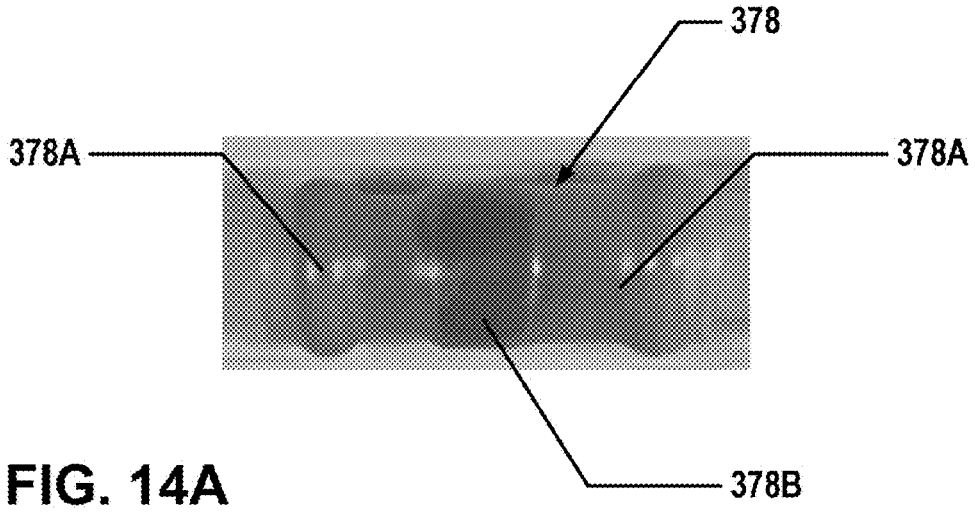
FIGS. 14A and 14B illustrate an alternative electrical connection method for the mounting cable and the power cable of FIG. 12A.
Figure 14B:
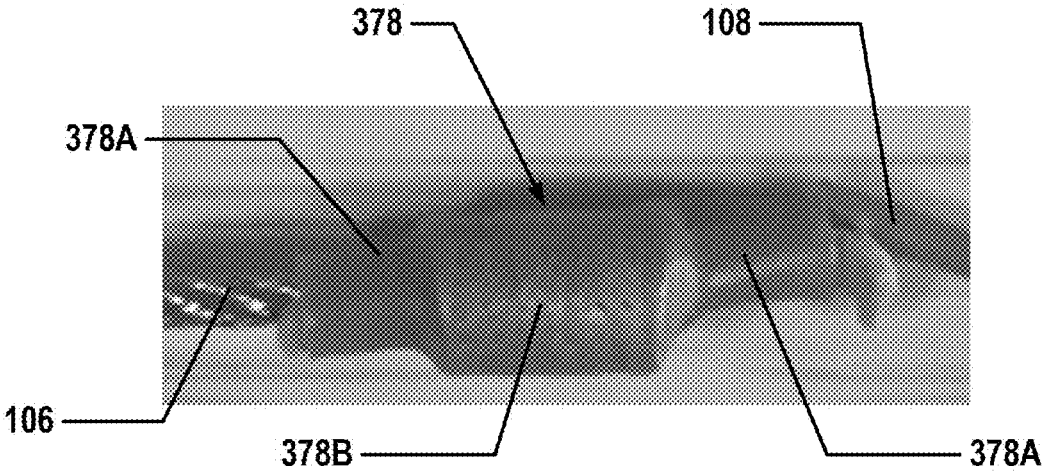

FIGS. 14A and 14B illustrate an alternative embodiment utilizing a solder sleeve 378 to electrically connect, cover, and isolate the electrical connection between the mounting cable 106 and the power cable 108. FIG. 14A illustrates a solder sleeve 378 and FIG. 14B illustrates the solder sleeve 378 connecting the mounting cable 106 and the power cable 108. The solder sleeve 378 may include a plastic portion 378A and a solder portion 378B. The solder sleeve 378 may be positioned over the end 108A of the power cable 108 and the end 106A of the mounting cable 106. The solder sleeve 378 may then be heated such that the solder portion 378B solders the mounting cable 106 to the power cable 108 and electrically connects the mounting cable 106 to the power cable 108. When the solder sleeve 378 is heated, the plastic portion 378A melts around the connection and thereby covers and protects the electrical connection of the mounting cable 106 and the power cable 108.

Further, FIGS. 13A-13D illustrate the connector 300 with the mounting cable 106 and the power cable 108 in various different angular configurations. As shown in FIGS. 13A-13D, the slot 352 on the connector 300 allows the power cable 108 to be angled for the mounting and connection of the luminaire to the ceiling.

Additionally, the top surface 302 of the connector 300 may have an opening 350 in the corner opposite the corner formed by side walls 304, 306 to allow for a securing structure to secure the connector 300 to the cover 200. The securing member (not shown) may be a threaded fastener where the opening 350 may have a countersink or counterbore region to keep the head of the fastener to lie flush or substantially flush with the top surface 302.

Additionally, the connector 300 may also have a plurality of holes positioned along the side walls to secure the connector 300 to the housing(s) 104 of the luminaire 102. Securing members (not shown) may be inserted into the plurality of holes into corresponding securing structures (not shown) in the housing(s) 104. For example as shown in FIG. 1, the plurality of holes 360, 362, 364, 366 are positioned within the side walls 304, 306. The holes 360, 362, 364, 366 may have a countersink or counterbore region on the interior surfaces of side walls 304, 306 to keep the head of the securing member to lie flush or substantially flush with the interior surfaces.

Materials

According to various aspects and embodiments, the cover 200 and the connector 300 may be formed of one or more of a variety of metallic materials (including metal alloys), such as, but not limited to, aluminum, aluminum alloys, steels (including stainless steels), titanium, and titanium alloys, or non-metallic materials, such as polymers, and composites (including fiber-reinforced composites) and may be formed in one of a variety of configurations, without departing from the scope of the invention. In one illustrative embodiment, both the cover 200 and connector 300 are made of metal. It is understood that the cover 200 and connector 300 may contain components made of several different materials, including fiber reinforced polymers, carbon-fiber composites, or similar materials.

The cover 200 and connector 300 may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques. If either of the cover 200 or connector 300 is made of non-metallic materials, they may have a metallic coating to increase the strength of the components.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. An integral connection system for a luminaire, comprising:

a cover comprising a base wall and only two cover side walls extending from the base wall with a first cover side wall, a second cover side wall, and a plurality of cover guides located on and extending from the first cover side wall and the second cover side wall, wherein the first cover side wall and the second cover side wall are connected to form a first angle; and a connector configured to engage with two housings of a luminaire, the connector comprising a top surface, a bottom surface, and only two connector side walls with a first connector side wall, a second connector side wall, and a plurality of connector guides located on the first connector side wall and the second connector side wall and;

wherein at least one of the cover guides slidably engages at least one of the connector guides, thereby providing a nested and hidden connection between the cover and the connector.

2. The integral connection system of claim 1, wherein the cover further comprises a protrusion on the base surface and the connector further comprises a recess on the bottom surface.

3. The integral connection system of claim 2, wherein the recess on the bottom surface of the connector receives at least a portion of the protrusion on the base surface of the cover.

4. The integral connection system of claim 1, wherein the plurality of cover guides are positioned along a first edge of the first side wall and a second edge of the second side wall.

5. The integral connection system of claim 1, wherein at least one of the cover guides includes a first surface and a second surface that are parallel and at least one of the connector guides includes a first surface and a second surface that are parallel.

6. The integral connection system of claim 1, wherein the cover and connector are slidably engaged.

7. The integral connection system of claim 1, wherein the cover and the connector are secured using a securing member.

8. The integral connection system of claim 1, wherein the cover further comprises a plurality of exterior surfaces that are free of any features.

9. The integral connection system of claim 1, wherein the connector further comprises a slot extending through the top surface, the first side wall, and the second side wall.

10. The integral connection system of claim 1, wherein the connector further comprises a slot extending through the first connector side wall and the connector side wall.

11. The integral connection system of claim 1, wherein the connector further comprises a first slot extending through the top surface, the first connector side wall, and the second connector side wall and a second slot extending through the first connector side wall and the second connector side wall, wherein a centerline of the first slot and a centerline of the second slot are coplanar.

12. The integral connection system of claim 11, wherein the connector further includes a bushing located in the first slot that is configured to receive a mounting cable to connect to a power cable electrically connected to an LED board.

13. A luminaire, comprising:

a first housing and a second housing with an LED board located in both the first housing and the second housing;

an integral connection system that includes a cover comprising a base surface, a bottom surface opposite the base surface, only two cover side walls extending from the base surface that include a first cover side wall having a first exterior surface, and a second cover side wall having a second exterior surface, a plurality of cover guides located on and extending from the first cover side wall and the second cover side wall and a securing system, wherein the first cover side wall and the second cover side wall are perpendicular to the base wall and are connected to form a 90 degree angle, and wherein the first exterior surface, the second exterior surface, and the bottom surface are smooth surfaces; and a connector attached to at least one of the first housing and the second, the connector comprising a top surface, a bottom surface, and only two connector side walls that include a first connector side wall, a second connector side wall, and a plurality of connector guides positioned on the first and second connector side wall;

wherein the cover and connector are slidably engaged along the cover guides and the connector guides forming a nested and concealed connection.

14. The luminaire of claim 13, wherein the cover further comprises a protrusion on the base surface and the connector further comprises a recess on the bottom surface.

15. The luminaire of claim 14, wherein the recess on the bottom surface of the connector receives at least a portion of the protrusion on the base surface of the cover.

16. The luminaire of claim 13, wherein the cover are positioned along a first edge of the first cover side wall and a second edge of the second cover side wall.

17. The luminaire of claim 13, wherein the cover guides includes a first surface and a second surface that are parallel and the connector guides includes a first surface and a second surface that are parallel.

18. The luminaire of claim 13, wherein the cover and the connector are secured using a mechanical fastener and the securing system of the cover includes a portion of a female thread.

19. The luminaire of claim 13, wherein the connector further comprises a slot extending through the top surface, the first connector side wall, and the second connector side wall.

20. The luminaire of claim 13, wherein the connector further comprises a slot extending through the first connector side wall and the second connector side wall between the top surface and the bottom surface.

21. The luminaire of claim 13, wherein the connector further comprises a first slot extending through a portion of the top surface, the first connector side wall, and the second connector side wall and a second slot extending through a portion the first connector side wall and the second connector side wall between the top surface and the bottom surface, wherein a centerline of the first slot and a centerline of the second slot are coplanar.

22. The luminaire of claim 21, wherein the wherein the connector further includes a bushing located in the first slot that receive a mounting cable to connect to a power cable electrically connected to the LED board.

23. An integral joint connection system for a luminaire, comprising:

a cover comprising a base surface, a bottom surface opposite the base surface, and only two cover side walls extending from the base surface with a first cover side wall having a first exterior surface, a second cover side wall having a second exterior surface, a plurality of cover guides located on and extending from the cover and a securing system, wherein the first cover side wall and the second cover side wall are perpendicular to the base wall and are connected to form a 90 degree angle, and wherein the first exterior surface, the second exterior surface, and the bottom surface are smooth surfaces; and a connector configured to engage with two housings of a luminaire, the connector comprising a top surface, a bottom surface, and only two side walls extending from the bottom surface with a first connector side wall, and a second connector side wall, a first slot extending through the top surface, the first connector side wall, and the second connector side wall, a second slot extending through the first connector side wall and the second connector side wall, and a plurality of connector guides positioned on the first and second connector side wall; wherein a centerline of the first slot and a centerline of the second slot are coplanar, and wherein the cover and connector are slidably engaged along the cover guides and the connector guides.

* * * * *